United States Patent [19]

Chang

[11] Patent Number: 4,531,764

[45] Date of Patent: Jul. 30, 1985

[54] LOOSE LEAF BINDER SPACER

[76] Inventor: Kwei K. Chang, 8664 Vesta Ter., Orlando, Fla. 32825

[21] Appl. No.: 542,390

[22] Filed: Oct. 17, 1983

[51] Int. Cl.[3] ..... B42D 3/00; B42F 13/00

[52] U.S. Cl. ..... 281/29; 402/80 R; 402/80 P

[58] Field of Search ..... 248/118, 459; 281/15 R, 281/20, 21 R, 23, 28, 29, 33; 402/80 R, 80 P, 79; 412/7, 8, 37, 900, 901; 227/DIG. 1

[56] References Cited

U.S. PATENT DOCUMENTS

| | | | |
|---|---|---|---|
| 3,542,321 | 11/1970 | Kahabka | 402/80 P X |
| 3,574,472 | 4/1971 | Cott | 402/71 X |
| 3,936,202 | 2/1976 | Brajituli | 281/33 X |
| 4,239,411 | 12/1980 | Moliard | 402/80 R X |
| 4,315,642 | 2/1982 | Errichiello | 281/33 |

*Primary Examiner*—Paul A. Bell
*Attorney, Agent, or Firm*—William M. Hobby, III

[57] ABSTRACT

A loose-leaf binder spacer apparatus is used to space the covers of an unfilled loose-leaf binder. It has a base portion for attaching to a page for inserting into a loose-leaf binder or to the inside cover of the loose-leaf binder and a spacing portion hinged to the base and positioned to space the binder covers. The spacer is adjustable between different spacing positions with an adjustable attachment. This allows the spacing portion to be attached to the base in different positions thereby varying an inverted V-portion height for different spacing positions. The attachment can be by means of hook and loop material, ball and socket, or other rapid fastening members.

11 Claims, 9 Drawing Figures

LOOSE LEAF BINDER SPACER

BACKGROUND OF THE INVENTION

The present invention relates to loose-leaf binders and especially to spacers for spacing the covers of unfilled loose-leaf binders.

In the past, a wide variety of loose-leaf binders have been provided for student and have been widely used for the filing of reference or other paged materials. The loose-leaf binders provide convenient storage, in that they allow the quick exchange of pages and the addition of pages as material accumulates on a subject. However, when a number of binders are stored on the same shelf and some are not completely full, the binders tend to become untidy as the edge portions, opposite the spine, tends to pie in. This is especially annoying when binders are supported by various types of bookends and makes it difficult to support the binders in an orderly fashion. This problem has not been widely addressed, but is discussed in one prior U.S. Pat. No. 2,453,459 to W. B. Roberts, which illustrates a cumbersome method of spacing loose-leaf binders by the placement of a special double spaced page in the binder between the binder covers and supporting the pages therebetween.

The present invention attempts to solve this problem in an inexpensive manner which can be easily added to existing binders or to sheets to be placed in binders without having to remove any pages from the existing binders or otherwise make any changes. This can be accomplished in a rapid manner with the present invention, which can be quickly adjusted for the different amount of page material in the binders.

SUMMARY OF THE INVENTION

The present invention relates to loose-leaf binders and especially to spacers adapted to be placed in loose-leaf binders for spacing the covers by varying degrees depending upon the thickness of paged material stored in the binders. The loose-leaf binder spacer has a base portion attachable to a surface in a loose-leaf binder, such as the inside cover of the binder or to a separate page which may be attached in the binder. The base may be attached with an adhesive having a removable protective cover. A binder cover spacing portion is hinged to the base on one end thereof and has an attaching means on the other end thereof for attaching the other end to the base. The binder cover spacing portion may have a generally inverted "V" shape with the attaching end having any of a variety of fasteners, including hook and loop material, as well as ball and socket fasteners, which allow a rapid readjustment of the binder cover spacing portion by flattening the legs of the inverted V to vary the distance between the point of the V and the base. The binder cover spacing portion can be hinged by merely forming a groove therein. In addition, the point of the inverted V can be formed with a second groove and a lip on the end of the V can be bent on a third groove.

BRIEF DESCRIPTION OF THE DRAWINGS

Other objects, features and advantages of the present invention will be apparent from the written description and the drawings, in which.

DESCRIPTION OF THE PREFERRED EMBODIMENTS

Figure 1:
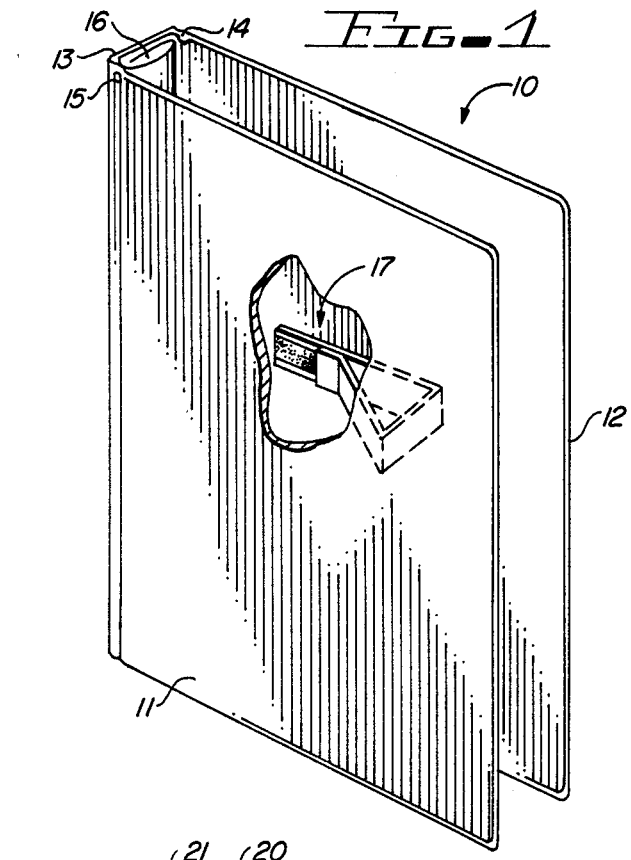
FIG. 1 is a broken-away perspective view of the present invention installed in a loose-leaf binder.
Figure 2:
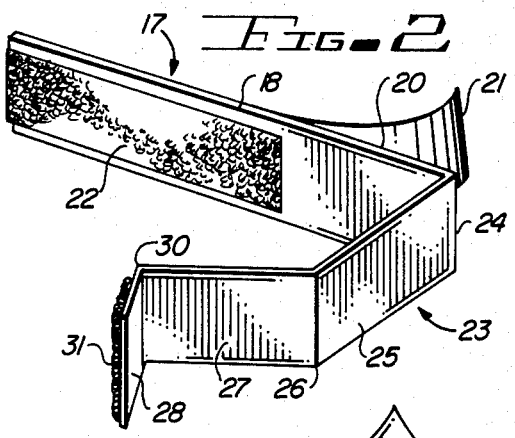
FIG. 2 is a perspective view of a loose-leaf binder spacer as attached in FIG. 1.
Figure 3:
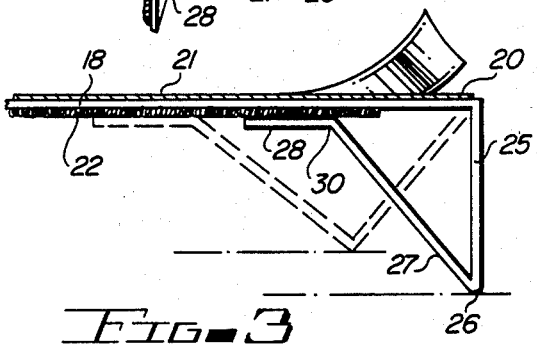
FIG. 3 is a side elevation of the loose-leaf binder spacer in accordance with FIGS. 1 and 2.

Referring to the drawings and especially to FIGS. 1 through 4, a loose-leaf binder 10 is illustrated having a first cover 11 and a second cover 12 connected to a spine 13 at hinged portions 14 and 15. The loose-leaf binder 10 has a opening ring mechanism 16 therein and has a loose-leaf binder spacer 17 attached inside the binder 10 of FIG. 1. The spacer 17 has a base portion 18 with an adhesive coating 20 on the bottom thereof covered by peel off paper 21, so that it can be readily attached to an inside page of the binder 10 or to an inside cover. The base 18 has a piece of hook and loop material 22 attached to the other side thereof from the adhesive coated side 20 and has a binder cover spacing portion 23 hinged thereto at 24. The binder cover spacing portion 23 has a first leg 25 hinged at 26 to a second leg 27 and has a lip 28 protruding from the bottom of the leg 27 and hinged with the hinge 30. The lip 28 has a second portion of hook and loop material 31 attached thereto for attaching to the hook and loop material 22, as shown in FIGS. 1 and 3. The hook and loop material of the lip 28 can be rapidly attached to any desired position on the hook and loop material 22 on the base 20 for adjusting the spacing, as shown in FIG. 3. to make the loose-leaf covers 11 and 12 generally parallel for proper storage in bookshelves or between bookends. The spacing will vary depending upon the thickness of the loose-leaf binder 10 as well as upon the amount of material being stored therein.

Figure 4:
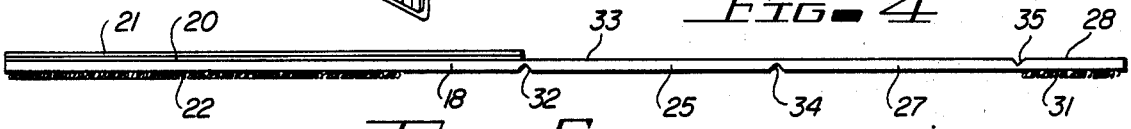
FIG. 4 is a side elevation of a loose-leaf binder spacer prior to folding into position for installation in the loose-leaf binder of FIG. 1.

In FIG. 4 the hinge 24 is formed with a groove 32 allowing the material 33 to be bent at that point while the hinge 26 is formed from a groove 34 allowing the material 33 to be bent and the hinge 30 is formed with a groove 35 on the other side of the material 33 from the grooves 32 and 34. In operation, the loose-leaf binder spacer portion 17 can be attached to the cover 11 of the loose-leaf binder 10 or it can be readily attached to a separate page attached in the ring binder and can rapidly have the hook and loop material 31 on the lip 28 attached to the appropriate position on the strip of hook and loop material 22 on the base 18. The unit is attached by peeling the paper 21 to expose the glue and then pressing to the appropriate surface.

Figure 5:
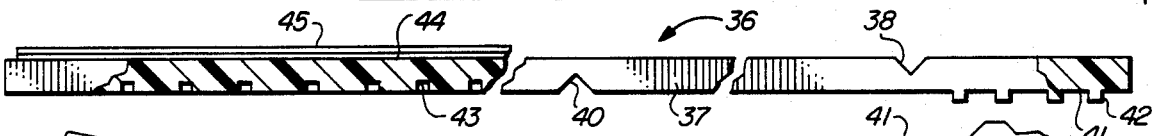
FIG. 5 is side elevation of a second embodiment of loose-leaf binder spacer.
Figure 6:
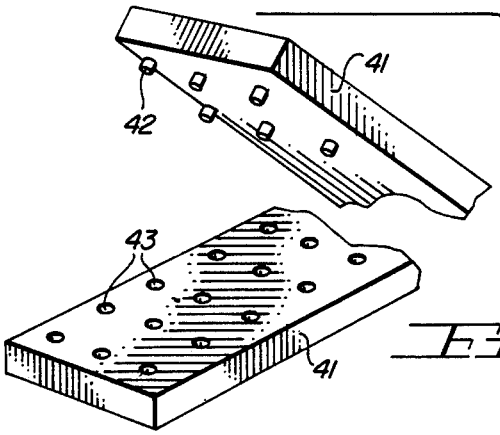
FIG. 6 is a partial perspective view of the loose-leaf binder spacer of FIG. 5.
Figure 7:
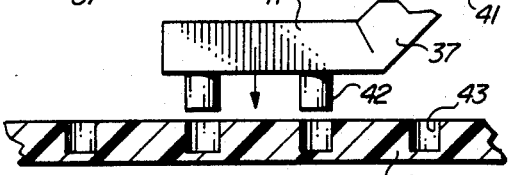
FIG. 7 is a partial side sectional view of the embodiment of FIGS. 5 and 6.
Figure 8:
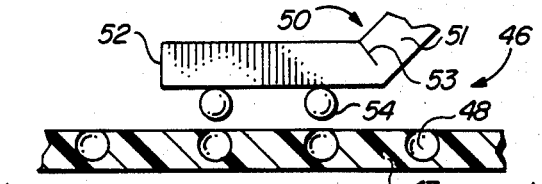
FIG. 8 is a side sectional view of an alternate embodiment of a loose-leaf binder spacer in accordance with the present invention.

Turning to FIGS. 5, 6 and 7, an alternate embodiment of a loose-leaf binder spacer 36 is illustrated made from a material 37 having hinged portions 38 and 40 along with a lip 41 hinged at 38 and having a plurality of male fastening members 42 thereon; while the material 37 has a plurality of female fastening members 43 on the opposite side from the members 42, so that when the members are folded as in FIG. 3, the attaching portions can be engaged in the appropriate positions for the proper spacing. Loose-leaf binder spacer 36 has an adhesive coating 44 over a portion thereof with a peel off protective cover 45.

FIG. 6 shows yet another embodiment of a loose-leaf binder spacer 46 having a base portion 47 with a plurality of sockets 48 therein and a spacing portion 50 having a leg 51 with a lip 52 hinged at 53 and having a series of balls 54 attached thereto for insertion in the sockets 48. The number of sockets 48 allow the unit to be attached in different positions to vary the spacing of the binding covers.

Figure 9:
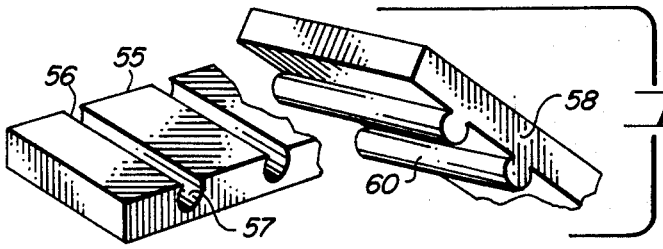
FIG. 9 is a partial perspective view of yet another embodiment of a loose-leaf binder spacer in accordance with the present invention.

Turning to FIG. 9, another embodiment is shown in which the base 55 has a plurality of grooves 56, each of which has slightly extending lip portions 57 to narrow the opening to the grooves, while the lip 58 has a plurality of generally cylindrical members 60 which can be press-fitted into the grooves 56 to thereby lock the spacing member in different positions.

It should be clear at this point that a loose-leaf binder spacer has been provided which can be inexpensively manufactured and rapidly attached for spacing the covers of loose-leaf binders. The spacer can be manufactured of a polymer material in one injection molding operation to further economize in the cost of the part. However, the present invention is not to be construed as limited to the forms shown, which are to be considered illustrative rather than restrictive.

I claim:

1. A loose-leaf binder having a spacer for spacing the binder covers comprising in combination:

a loose-leaf binder having a pair of covers;

a base portion attached to one cover in said loose-leaf binder;

a loose-leaf binder cover spacing portion attached to the base portion to space the loose-leaf binder covers between said base and said spacing portion, said spacing portion being adjustable between different spacing positions; and attaching means for attaching a portion of said spacing portion in different positions to said base, said attaching means including a pair of facing surfaces, each facing surface having an attaching means portion thereon for attaching said surfaces together by pressing one facing surface to the other, thereby varying the spacing of said binder covers.

2. A loose-leaf binder in accordance with claim 1, in which said binder cover spacing portion has one end hinged to said base portion.

3. A loose-leaf binder in accordance with claim 2, in which said binder cover spacing portion forms a generally inverted V-shape having adjustable legs for varying the spacing in said loose-leaf binder.

4. A loose-leaf binder in accordance with claim 3, in which said binder cover spacing portion inverted V-portion has a lip hinged to one leg thereof and protruding therefrom and having one facing surface of said attaching means attached thereto.

5. A loose-leaf binder in accordance with claim 4, in which said base portion has a strip of hook and loop material thereon for engaging a strip of hook and loop material on said lip protruding from one leg of said inverted V binder cover spacing portion.

6. A loose-leaf binder in accordance with claim 4, in which said attaching means is ball and socket fasteners for attaching said binder cover spacing portion lip to the base portion thereof in different positions.

7. A loose-leaf binder in accordance with claim 1, in which said binder cover spacing portion is hinged to said base portion with a hinge formed of an elongated groove.

8. A loose-leaf binder in accordance with claim 7, in which said loose-leaf binder spacer has a second groove therein at the apex of said inverted V for forming a hinge therein.

9. A loose-leaf binder in accordance with claim 8, in which said loose-leaf binder spacer has a third groove formed in said binder cover spacing portion to form a hinge portion between one leg of said inverted V and said lip.

10. A loose-leaf binder in accordance with claim 1, in which said base portion has an adhesive coating thereon for attaching to the inside of a loose-leaf binder.

11. A loose-leaf binder in accordance with claim 10, in which said adhesive coating has a peel off cover for peeling off for attaching in said loose-leaf binder.

* * * * *